United States Patent [19]

Mizuno et al.

[11] Patent Number: 4,505,253

[45] Date of Patent: Mar. 19, 1985

[54] WATER HEATER

[75] Inventors: Sueo Mizuno; Katsushi Mizutani; Masahiko Koumura, all of Nagoya, Japan

[73] Assignee: Rinnai Kabushiki Kaisha, Nagoya, Japan

[21] Appl. No.: 576,310

[22] Filed: Feb. 2, 1984

[30] Foreign Application Priority Data

Feb. 4, 1983 [JP] Japan ..... 58-14490[U]

[51] Int. Cl.[3] ..... F23H 1/00

[52] U.S. Cl. ..... 126/351; 122/448 R; 236/25 A; 431/42; 431/60

[58] Field of Search ..... 122/448 R, 448 A, 448 S; 126/351; 236/24, 25, 25 A; 431/42, 60

[56] References Cited

U.S. PATENT DOCUMENTS

| | | | |
|---|---|---|---|
| 3,383,042 | 5/1968 | Mobus et al. | 236/25 A |
| 4,304,249 | 12/1981 | White | 122/448 R X |
| 4,346,835 | 8/1982 | Trotter et al. | 122/448 R X |
| 4,429,682 | 2/1984 | Huang | 126/351 |

FOREIGN PATENT DOCUMENTS 7105529 6/1982 Japan .

*Primary Examiner*—Edward G. Favors
*Attorney, Agent, or Firm*—Armstrong, Nikaido, Marmelstein & Kubovcik

[57] ABSTRACT

A water heater is disclosed having a main burner for heating a heat exchanger and a standing burner, and is also provided with an electromagnetic safety valve which is opened by a manual operation member and which is kept in its valve open condition by the electric current from a thermocouple element exposed to the standing burner and a water pressure sensitive member such that it opens in response to a supply of water to the heat exchanger (that is, the water flow is turned on). Both the electromagnetic safety valve and the water pressure sensitive valve are interposed in a fuel passage connected to the main burner. A standing burner fuel passage is connected on one end to the standing burner and is connected at its other end to a point located in between the two valves. Additionally there is provided a control circuit which has a capacitor, a discharging circuit for the capacitor having a solenoid operating the electromagnetic safety valve, and a changeover switch adapted to be switched by the manual operation member for charging or to the discharging circuit for discharging. A subsidiary discharge circuit for the capacitor is further provided having a switch which is interposed therein, and adapted to be closed when the supply of water to the heat exchanger is on. The subsidiary discharging circuit is in parallel with the foregoing discharging circuit, and a resistance is interposed between the two discharging circuits. Thus, when the control switch is closed and the subsidiary discharging circuit conducts, the solenoid does not become actuated and the electromagnetic safety valve is closed.

4 Claims, 2 Drawing Figures

WATER HEATER

BACKGROUND OF THE INVENTION

This invention relates to a water heater, and is more particularly directed to a water heater of the type having a main burner for heating a heat exchanger and a standing burner. This water heater also has an electromagnetic safety valve, which is opened by a manual operating member and which is kept in its valve open condition by an electric current from a thermocouple element which is exposed to the standing burner and a water pressure sensitive member such that it opens in response to a supply of water in the heat exchanger (that is, the water flow is turned on). Both the electromagnetic safety valve and the water pressure sensative valve are interposed in a fuel passage connected to the main burner. A standing burner fuel passage has one end connected to the standing burner and is connected at its other end to a point in between the two valves.

It has been usual with this type of water heater that, if the manual operation member is depressed, the electromagnetic safety valve is opened and at the same time an operation switch for an ignition device is closed, thereby igniting the standing burner. If, after the completion of this ignition operation, the heat exchanger is supplied with water, the water pressure sensitive valve is then opened by a water pressure responsive member, thereby the main burner is fired.

It is also known that this type of water heater may be provided with a control circuit which comprises a capacitor, a discharging circuit for the capacitor with a solenoid operating the safety valve, and a changeover switch adapted to be switched by the manual operation member between a charging condition where the capacitor is being charged by an electric power source and a discharging condition where the capacitor is connected to the discharging circuit.

The known water heater having this control circuit, however, is undesirable, because unburned fuel may be discharged from the main burner. When the electromagnetic safety valve is kept in its valve open condition by the action of the discharging circuit immediately after the manual operation member is operated, and if the heat exchanger is supplied with water under the condition that the standing burner is not yet iginited substantially simultaneously with the depression of the manual operation member or if the manual operation member is depressed under the condition that the heat exchanger is supplied with water, then both the electromagnetic safety valve and the water pressure sensitive valve are brought into their valve open condition. Consequently, despite the fact that the standing burner is not yet ignited, a large amount of gas is supplied to the main burner, resulting in a discharge of unburned gas.

SUMMARY OF THE INVENTION

This invention has for its object to provide a water heater free from the above defect. In a water heater having a main burner for heating a heat exchanger and a standing burner, there is provided an electromagnetic safety valve which is opened by a manual operation member and which is kept in its valve open condition by the electric current from a thermocouple element exposed to the standing burner and a water pressure sensitive member such that it opens in response to a supply of water to the heat exchanger (that is, the water flow is turned on). Both the electromagnetic safety valve and the water pressure sensitive valve are interposed in a fuel passage connected to the main burner. A standing burner fuel passage is connected on one end to the standing burner and is connected at its other end to a point located in between the two valves. Additionally there is provided a control circuit which comprises a capacitor, a discharging circuit for the capacitor having a solenoid operating the electromagnetic safety valve, and a changeover switch adapted to be switched by the manual operation member for charging or to the discharging circuit for discharging. A subsidiary discharge circuit for the capacitor is further provided having a switch which is interposed therein, and adapted to be closed when the supply of water to the heat exchanger is on. The subsidiary discharging circuit is in parallel with the foregoing discharging circuit, and a resistance is interposed between the two discharging circuits. Thus, when the control switch is closed and the subsidiary discharging circuit conducts, the solenoid does not become actuated and the electromagnetic safety valve is closed.

BRIEF DESCRIPTION OF THE DRAWINGS

The above and other objects and the attendant advantages of the present invention will become readily apparent by reference to the following detailed description when considered in conjunction with the accompanying drawing wherein.

DETAILED DESCRIPTION OF THE INVENTION

Figure 1:
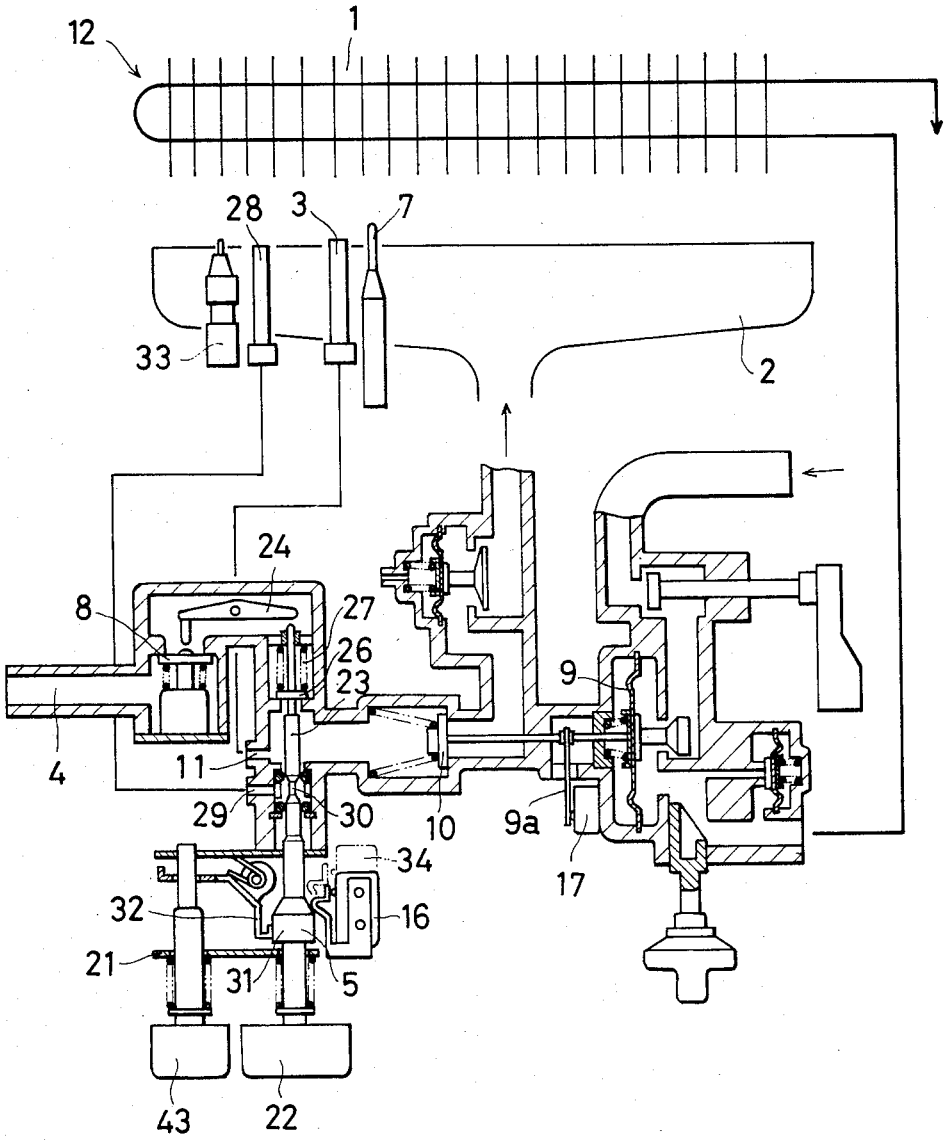
FIG. 1 is a sectional side view of one embodiment of the water heater according to this invention.
Figure 2:
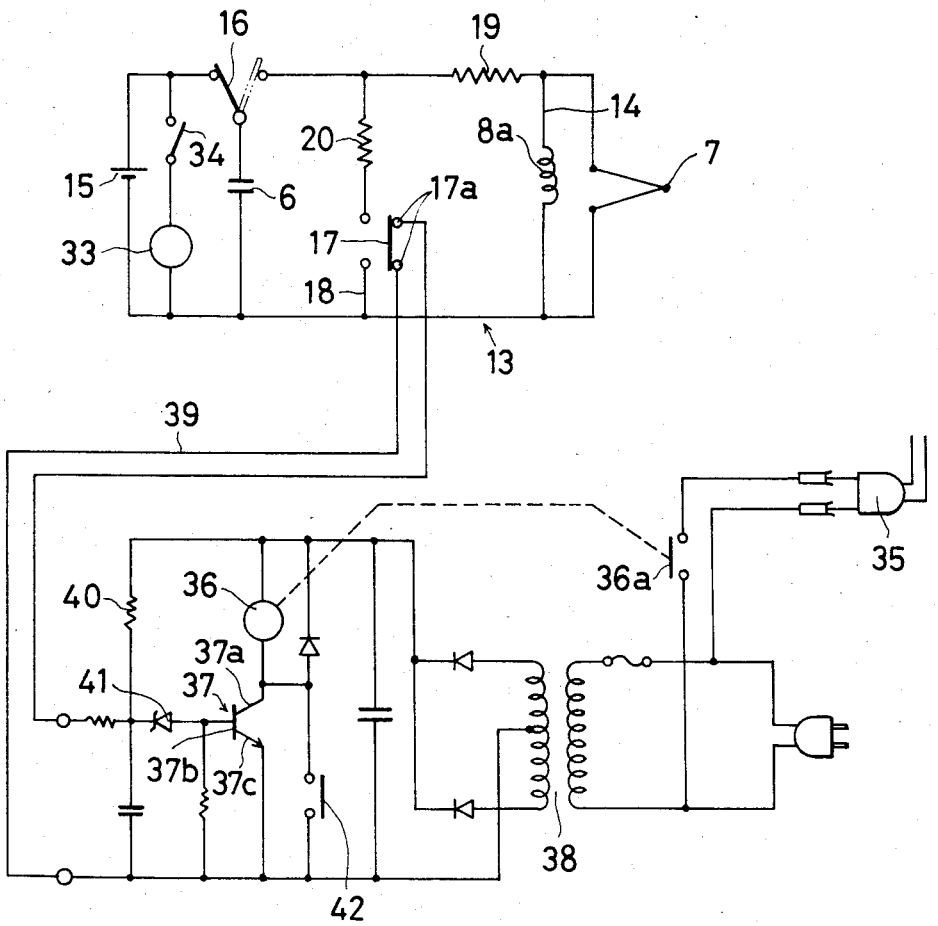
FIG. 2 is a schematic diagram showing a control circuit portion thereof.

Referring to FIGS. 1 and 2, a water heater assembly 12 is disclosed. Numeral 1 denotes a heat exchanger, numeral 2 denotes a main burner for heating the same, and numeral 3 denotes a standing burner 3. In a fuel passage 4 connected to the main burner 2, there are interposed an electromagnetic safety valve 8 which is adapted to be opened by a manual operation member 5 and kept in its valve open condition by the use of an electric charge stored in capacitor 6 and an electric current from thermocouple element 7 which is exposed to the standing burner 3, and a water pressure sensitive valve 10 having a water pressure sensitive member 9, such that it opens in response to a supply of water being turned on and supplied to heat exchanger 1. A standing burner fuel passage 11 is connected to standing burner 3 and is connected on its other end to a portion of the fuel passage 4 at at a point between the two valves 8 and 10.

In addition, water heater assembly 12 is provided with a control circuit 13 which comprises the above-mentioned capacitor 6, a discharging circuit 14 for capacitor 6 with a solenoid 8*a* operating safety valve 8. A changeover switch 16 is provided to be operated by manual operatin member 5 such that it connects capacitor 6 selectively to either the power source 15 or discharging circuit 14. According to this invention, a subsidiary discharging circuit 18 for capacitor 6 has a control switch 17 which is interposed therein and is adapted to be closed in conjunction with the water supply to the heat exchanger 1 being on. Subsidiary discharging circuit 18 is provided in control circuit 13 to be in parallel with discharging circuit 14. Resistance 19 is interposed between the two discharging circuits 14, 18. Numeral 20 denotes a resistance interposed in the foregoing subsidiary discharging circuit 14. Switch 17 is adopted to be closed by projection member 9a projecting from the water pressure sensitive member 9.

The manual operation member 5 comprises a push button 22 inserted through an operation panel 21 forming a front surface of the water heater assembly 12. An operation rod 23 extends rearward into the fuel passage 4, and a lever 24 is engageable at its one end with a rear end of the rod 23. Electromagnetic safety valve 8 is provided in front of and engageable with the other end of lever 24. Rod 23 is provided with a stop valve 26 fixed thereto. Thus, if the push button 22 of the manual operation member 5 is pushed from its starting end position, against the biasing action of spring 27, at its intermediate position, stop valve 26 is opened and at its final end position, electromagnetic safety valve 8 is opened through the operation of lever 24.

As seen in FIG. 1, ignition passage 29 is connected to ignition burner 28 which is in parallel with the standing burner 3. Ignition passage 29 is in communication with the portion of the fuel passage 4 that contains the operation rod 23. At ignition passage 29, operation rod 23 forms an ignition valve 30 comprising a smaller diametrical portion in order to provide communiation between ignition passage 29 and fuel passage 4 when push button 22 is depressed to its final end position. Thus, if the push button 22 is pushed to its final end position, the standing burner 3 is supplied with gas through electromagnetic safety valve 8 and stop valve 26. The ignition burner 28 is therefore, supplied with gas through the iginition valve 30.

Further, when push button 22 is released from being depressed to its final end position, manual operation rod 5 returns toward its starting position, but is stopped in its return movement at its intermediate position by claw member 32 which becomes engaged with the shoulder of projection 31 formed thereon. Manual operation rod 5 is then returned to its starting end position if claw member 32 is released from engagement by the depression of extinguishing button 43 provided on assembly 12 separate from push button 22.

Numeral 33 denotes an ignition device provided near ignition burner 28. An ignition switch 34 for the ignition device 33 is closed by the operation of push button 22 when push button 22 reaches its final end position. Additionally, changeover switch 16 is designed to be switched at the intermediate position of push button 22, so that capacitor 6 is connected to discharging circuit 14.

Next, the operation of the foregoing example will be explained as follows:

Under the condition that the heat exchanger 1 is supplied with water, if push button 22 is depressed, changeover switch 16 is then switched from the charging circuit side to the discharging circuit 14 side. In this case, because control switch 17, interposed in the subsidiary discharging circuit 18, is closed by the water supply operation, the electric charge of the capacitor 6 is discharged through the subsidiary discharging circuit 18, and because resistance 19 exists between the two discharging circuits 14 and 18, no electric current flows through the discharging circuit 14. Consequently, the electromagnetic safety valve 8 is opened for a moment by the pusing operation of the push button 22 but is immediately closed, and electromagnetic safety valve 8 is thereby prevented from remaining open and consequently a large amount of unburned gas is prevented from being discharged from the main burner 2 as would have happened in the known example mentioned above.

Under the condition that there is no supply of water, control switch 17 is kept in its open condition, so that if the push button 22 is operated and changeover switch 16 is switched to discharging circuit 14 side, the electric chage of capacitor 6 is discharged through discharging circuit 14, and thereby the solenoid 8a is immediately energized to keep safety valve 8 in its valve open condition. Thus, combustion begins at ignition burner 28 and standing burner 3 and an electric current is provided from thermocouple element 7 by the burning of standing burner 3. Safety valve 8 is then kept in its valve open condition by the electric current from thermocouple element 7 after the discharge of capacitor 6.

If the water supply is carried out at such an early stage that standing burner 3 is ignited immediately after the depression of push button 22, but the electric current from thermocouple element 7 caused by standing burner 3 is not yet large enough to keep safety valve 8 in its open condition, control switch 17 is closed and accordingly the electric charge of capacitor 6 is discharged through subsidiary discharging circuit 18, and consequently solenoid 8a is not energized. Accordingly, it often happens that, in spite of the fact that standing burner 3 is being burnt, safety valve 8 is closed. This inconvenience can be removed by having resistance 20 interposed in subsidiary discharging circuit 18 so that the discharging operation through subsidiary discharging circuit 18 may be slightly delayed.

Referring to FIG. 2, numeral 35 denotes an operation circuit for a ventilation fan. A relay contact 36a is interposed therein, and is operated by relay 36. Relay 36 is connected to an electric power source 38 on one side and collector 37a of transistor 37 on the other side thereof. Transistor 37 operates as a switch having switch 17 interposed at its outside subsidiary contact points 17a in a circuit 39 connected at one side to transistor base 37b and at the other side to transistor collector 37c.

If, with this arrangement, heat exchanger 1 is supplied with water, control switch 17 is closed causing the subsidiary discharging circuit 18 to conduct and at the same time opening the circuit 39, whereby transistor base 37b is applied with a voltage through resistance 40 and diode 41. Accordingly, transistor 37 switches ON between its emitter 37a and its collector 37c, and thus causing relay 36 to become energized. Relay contact 36a then is closed to operate the ventilation fan. In other words, when heat exchanger 1 is supplied with water, that is when the water pressure sensitive valve 10 is opened for supplying gas to main burner 2, the ventilation fan is always turned on. Numeral 42 denotes a manual switch.

Thus, according to this invention, a subsidiary discharging circuit for a capacitor with a control switch interposed therein, and arranged to be closed in conjunction with a water supply operation, is so provided. This subsidiary discharge circuit is disposed in a control circuit so as to be in parallel with a discharge circuit for the capacitor, such that, even if a manual operation member is operated under the condition of water being supplied to the heat exchanger, a discharge from the capacitor is effected through the subsidiary discharging circuit and no electric current is supplied to a solenoid. Thus a condition where an electromagnetic safety valve is kept in its open valve condition allowing a large amount of unburned gas to be discharged through a main burner (as in the known example), is prevented. Additionally, a resistance is interposed between the two discharging circuits, so that an inconvenient condition where at the time of water supply, an electric current flows, by accident, through the discharging circuit because of a change in a resistance value of the control switch interposed in the subsidiary discharging circuit, is also prevented. Further, the instant invention prevents an electric current from a thermocouple element from being leaked out towards the subsidiary discharging circuit.

It is readily apparent that the above-described invention meets all of the objects mentioned above and also has the advantage of wide commercial utility. It should be understood that the specific form of the invention hereinabove described is intended to be representative only, as certain modifications within the scope of these teachings will be apparent to those skiled in the art.

Accordingly, reference should be made to the following claims in determining the full scope of the invention.

We claim:

1. A water heater of the type having a main burner for heating a heat exchanger and a standing burner, and an electromagnetic safety valve adapted to be opened by a manual operation member and to be kept in its valve open condition by an electric current from a thermocouple element exposed to the standing burner and a water pressure sensitive member, which opens in response to the supply of water to the heat exchanger being turned on are interposed in a fuel passage connected to the main burner, and a standing burner fuel passage connected at one end to the standing burner and at its other end to a point located in between the two valves, and additionally there is provided a control circuit which comprises a capacitor, a discharging circuit for the capacitor with a solenoid which operates the electromagnetic safety valve which is interposed therein, and a changeover switch adapted to be so operated by the manual operation member as to connect the capacitor selectively to either an electric power source or the discharging unit, characterized in that the control circuit includes a subsidiary discharging circuit for the capacitor with a control switch which is interposed therein and is adapted to be closed when the supply of water to the heat exchanger is on, said subsidiary discharging circuit being in parallel with the foregoing discharging circuit and including a resistance means for delaying the discharge of said capacitor, and said control circuit having a resistance interposed between the two discharging circuits.

2. The water heater of claim 1, wherein the control switch is used also for controlling an electric circuit for operating a ventilation fan.

3. The water heater of claim 2, wherein a relay having a relay contact interposed in an operation circuit for a ventilation fan is connected to an electric power source through a transistor serving as switching element, and said control switch is interposed at its outside subsidiary contact points in a circuit connecting the base of the transistor to the collector of the transistor.

4. A water heater for heating a heat exchanger, comprising:

a main burner;

a standing burner;

a fuel supply;

a fuel passage means for supplying fuel from said fuel supply to said main burner and said standing burner;

an electromagnetic valve means disposed between said fuel supply and said two burners for opening to allow fuel to flow to said two burners, said electromagnetic valve means being operable to the open position by a manual operation member and being kept in the open position by an electric current from a thermocouple element exposed to the standing burner;

a water pressure senstive valve means, responsive to a water pressure sensitive member, for opening a valve in said fuel passage means when the supply of water in the heat exchanger is on, said water pressure sensitive valve means being disposed between said electromagnetic valve means and said main burner;

a fuel line being provided to said standing burner from a point in between said two valve means; and a control circuit including, a capacitor, a discharging circuit for said capacitor having a solenoid which operates said electromagnetic safety valve means, a changeover switch adapted to be operated by the manual operation member, such that said capacitor is connected to either an electric power source or said discharging circuit, and a subsidiary discharging circuit for said capacitor having a control switch whcih is closed when the supply of water to the heat exchanger is on, and is in parallel with said discharging circuit, said control circuit having a resistance means interposed between said two discharging circuits.

* * * * *